US011324369B2

(12) United States Patent
Kim

(10) Patent No.: US 11,324,369 B2
(45) Date of Patent: May 10, 2022

(54) ROBOT CLEANER

(71) Applicant: Samsung Electronics Co., Ltd., Suwon-si (KR)

(72) Inventor: Byung Chan Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 304 days.

(21) Appl. No.: 16/681,079

(22) Filed: Nov. 12, 2019

(65) Prior Publication Data

US 2020/0146521 A1 May 14, 2020

(30) Foreign Application Priority Data

Nov. 13, 2018 (KR) ..... 10-2018-0139085

(51) Int. Cl.

*A47L 9/16* (2006.01)
*A47L 9/04* (2006.01)
*A47L 9/10* (2006.01)

(52) U.S. Cl.

CPC ..... *A47L 9/1608* (2013.01); *A47L 9/0477* (2013.01); *A47L 9/106* (2013.01); *A47L 9/165* (2013.01); *A47L 9/1658* (2013.01); *A47L 9/1683* (2013.01); *A47L 2201/00* (2013.01)

(58) Field of Classification Search

CPC .... A47L 2201/00; A47L 9/0477; A47L 9/106; A47L 9/122; A47L 9/1409; A47L 9/16; A47L 9/1608; A47L 9/1625; A47L 9/165; A47L 9/1658; A47L 9/1683

See application file for complete search history.

(56) References Cited

U.S. PATENT DOCUMENTS

2006/0123590 A1* 6/2006 Fester ..... A47L 9/1683 15/353
2015/0245754 A1* 9/2015 Jang ..... A47L 11/4066 15/49.1
2016/0150931 A1* 6/2016 Kim ..... A47L 9/16 15/353
2016/0174800 A1* 6/2016 Conrad ..... A47L 9/1691 15/353
2016/0174802 A1* 6/2016 Conrad ..... A47L 9/325 15/329

(Continued)

FOREIGN PATENT DOCUMENTS

JP 5965513 B2 8/2016
KR 10-1208495 B1 12/2012

OTHER PUBLICATIONS

European Search Report dated Mar. 31, 2020, issued in European Application No. 19208883.9-1016.

*Primary Examiner* — Marc Carlson
(74) *Attorney, Agent, or Firm* — Jefferson IP Law, LLP

(57) ABSTRACT

A robot cleaner capable of extending the service life of a filter by including a cyclone unit is provided. The robot cleaner includes a main body including wheels configured to rotate about a rotation axis, a brush device provided in the main body to draw in air containing dust, a first chamber, through which the air drawn in through the brush device is introduced, configured to change a traveling direction of the introduced air, and a second chamber connected to the first chamber and including a dust separator separating dust contained in air, and arranged side by side with the first chamber in a direction in which the rotation axis extends.

19 Claims, 6 Drawing Sheets

(56) References Cited

U.S. PATENT DOCUMENTS

| | | | | |
|---|---|---|---|---|
| 2016/0367092 | A1* | 12/2016 | Conrad | A47L 5/30 |
| 2017/0273526 | A1* | 9/2017 | Love | A47L 9/102 |
| 2018/0177367 | A1* | 6/2018 | Amaral | A47L 9/0477 |
| 2019/0261824 | A1* | 8/2019 | Conrad | A47L 9/22 |

* cited by examiner

ROBOT CLEANER

CROSS-REFERENCE TO RELATED APPLICATION(S)

This application is based on and claims priority under 35 U.S.C. § 119(a) of a Korean patent application number 10-2018-0139085, filed on Nov. 13, 2018, in the Korean Intellectual Property Office, the disclosure of which is incorporated by reference herein in its entirety.

BACKGROUND

1. Field

The disclosure relates to a robot cleaner. More particularly, the disclosure relates to a robot cleaner including a cyclone dust separator.

2. Description of Related Art

A robot cleaner is a device for automatically cleaning a space by suctioning foreign substances such as dust accumulated on a floor while traveling in the space without being operated by a user. The robot cleaner may autonomously travel the space and clean the space. In general, a main body of the robot cleaner including a dust separator may have a relatively large volume. When the volume of the robot cleaner is large, there are many places where the robot cleaner is difficult to enter, thereby degrading the driving performance of the robot cleaner.

In order to prevent the volume of the body of the robot cleaner from increasing, the robot cleaner may not include the dust separator. However, a filter of the robot cleaner which does not include the dust separator may be easily clogged by foreign substances such as dust. When the filter is clogged, the cleaning performance of the robot cleaner is reduced. Therefore, a user needs to perform maintenance such as replacing or cleaning the filter.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a robot cleaner capable of improving the dust separation efficiency by including a cyclone dust separator.

Another aspect of the disclosure is to provide a robot cleaner capable of extending the service life of a filter by improving the dust separation efficiency.

Another aspect of the disclosure is to provide a robot cleaner capable of having a compact main body size despite including a cyclone dust separator.

Another aspect of the disclosure is to provide a robot cleaner capable of extending the service life of a filter by including a cyclone dust separator and capable of improving the driving performance by having a compact main body size.

Additional aspects will be set forth in part in the description which follows and, in part, will be apparent from the description, or may be learned by practice of the presented embodiments.

In accordance with an aspect of the disclosure, a robot cleaner is provided. The robot cleaner includes a main body including wheels configured to rotate about a rotation axis, a brush device provided in the main body to draw in air containing dust, a first chamber, through which the air drawn in through the brush device is introduced, configured to change a traveling direction of the introduced air, and a second chamber connected to the first chamber and including a dust separator configured to separate dust contained in air, and arranged side by side with the first chamber in a direction in which the rotation axis extends.

The direction of air introduced into the first chamber and the direction of air discharged from the first chamber may cross each other.

The direction of air introduced into the second chamber and the direction of air discharged from the second chamber may cross each other.

The dust separator may include a cyclone unit.

The cyclone unit may include a plurality of cyclone units arranged in two or more rows along a first direction in which the rotation axis extends.

When the rows extend in a second direction crossing the first direction, each of a plurality of first cyclone units arranged along a first row and each of a plurality of second cyclone units arranged along a second row may be disposed to cross each other with respect to the first direction.

The cyclone units may be arranged to be inclined at a predetermined angle with respect to the direction in which the rotation axis extends. In an embodiment, the cyclone units are arranged to be inclined at a predetermined angle with respect to the direction in which the rotation axis extends to lower the height of the second chamber.

The first chamber may further include a first filter arranged side by side with a bottom surface.

The first filter may include a mesh or a plate including pores.

The second chamber may include a second filter disposed to cover a discharge port through which air is discharged from the second chamber.

The wheels may include a first wheel and a second wheel disposed at opposite sides of the main body, and the first chamber and the second chamber may be disposed between the first wheel and the second wheel.

The robot cleaner may further include a battery disposed inside the main body, wherein the battery and the first chamber may be arranged side by side in a second direction crossing a first direction in which the rotation axis extends.

The robot cleaner may further include a suction motor arranged side by side with the battery in the first direction and configured to generate a suction force, wherein the second chamber and the suction motor may be arranged side by side in the second direction.

The second chamber may be disposed to be biased to one side with respect to a central axis in an advancing direction of the main body.

The first chamber may include an inlet port through which air is introduced into the first chamber and a communication hole allowing the first chamber to communicate with the second chamber, and the second chamber may include the communication hole through which air is introduced into the second chamber from the first chamber and a discharge port through which air is discharged from the second chamber.

The communication hole may be disposed at a higher position than the inlet port and the discharge port.

In accordance with another aspect of the disclosure, a robot cleaner is provided. The robot cleaner includes a main body including a suction port configured to draw in dust, and a dust container, detachably mounted to the main body, configured to separate and store dust from air drawn in through the suction port, wherein the dust container includes a first chamber in which air is introduced in a first direction and air is discharged in a second direction crossing the first direction, and a second chamber in which air is introduced in the second direction and air is discharged in the first direction, and the second chamber includes a dust separator configured to separate dust contained in air and arranged side by side with the first chamber in the second direction.

The dust separator may include a plurality of cyclone units arranged in two or more rows along the second direction.

The plurality of cyclone units may be arranged to be inclined at a predetermined angle with respect to the second direction. In an embodiment, the plurality of cyclone units may be arranged to be inclined at a predetermined angle with respect to the second direction to lower the height of the dust container.

The dust container may further include a first filter provided inside the first chamber and arranged side by side with a bottom surface, and a second filter configured to cover a discharge port through which air is discharged from the second chamber and disposed perpendicular to the bottom surface.

In accordance with another aspect of the disclosure, a robot cleaner is provided. The robot cleaner includes a main body and a dust container detachably mounted to the main body, wherein the dust container includes a first chamber and a second chamber arranged side by side in a direction crossing an advancing direction of the main body, the first chamber includes an inlet port through which air is introduced, and a communication hole disposed at a higher position than the inlet port and allowing the first chamber to communicate with the second chamber, and the second chamber includes a discharge port through which air introduced into the communication hole is discharged and disposed at a lower position than the communication hole, and a cyclone unit configured to separate dust contained in air.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The terms used herein are for the purpose of describing the embodiments and are not intended to restrict and/or to limit the disclosure. For example, the singular expressions herein may include plural expressions, unless the context clearly dictates otherwise. Also, the terms "comprises" or "has" are intended to indicate that there are features, numbers, operations, elements, parts, or components thereof described in the specification, and do not exclude the presence or addition of one or more other features, numbers, operations, elements, parts, or components thereof.

It will be understood that although the terms first, second, etc. may be used herein to describe various components, these components should not be limited by these terms, and the terms are only used to distinguish one component from another. For example, without departing from the scope of the disclosure, the first component may be referred to as a second component, and similarly, the second component may also be referred to as a first component.

Hereinafter, embodiments of the disclosure will be described in detail with reference to the accompanying drawings.

Figure 1:
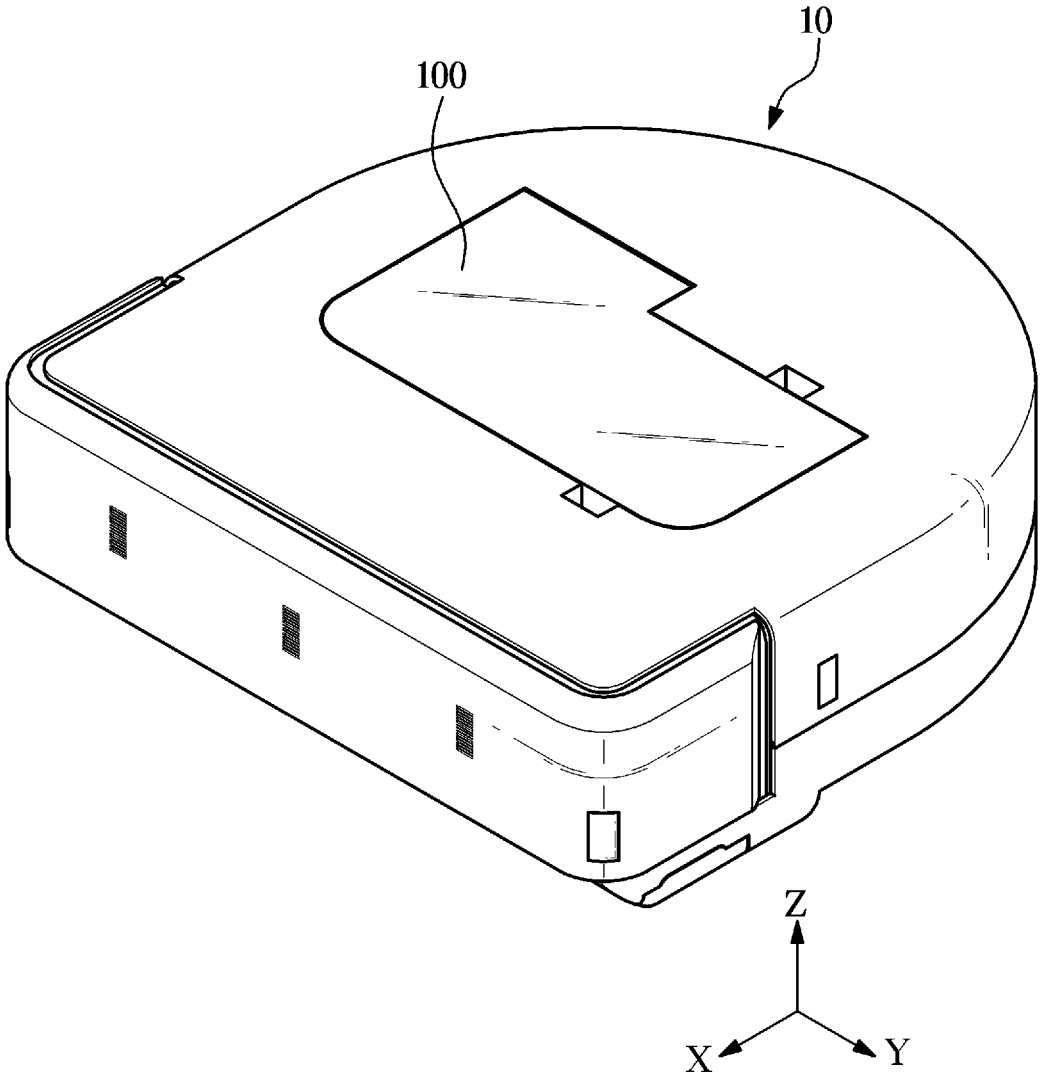
FIG. 1 is a perspective view of a robot cleaner according to an embodiment of the disclosure.

FIG. 1 is a perspective view of a robot cleaner according to an embodiment of the disclosure.

Referring to FIG. 1, a robot cleaner may include a main body 10 and a dust container 100 coupled to the main body 10. The dust container 100 may be separated from the main body 10. The robot cleaner may be provided to draw in or pull dust from a floor with air while traveling along the floor. The robot cleaner may separate and store the dust from the drawn in air and discharge the air from which the dust is removed.

The dust container 100 may be provided to separate and store dust. The dust container 100 may be detachably coupled to the main body 10 so that a user may remove dust inside the dust container 100.

The robot cleaner may generally be used at home. It is appropriate that the height of the robot cleaner allows for movement of the robot cleaner within a house without restriction. In this case, the height of the robot cleaner may refer to the length of the robot cleaner in the z-axis direction. If the height of the robot cleaner is relatively high, it is difficult for the robot cleaner to enter under furniture such as a bed. Because of this, a region cleanable by the robot cleaner may be reduced. When the cleanable region is reduced, the usability of the robot cleaner may be reduced. Therefore, it is appropriate that the height of the robot cleaner is low.

Figure 2:
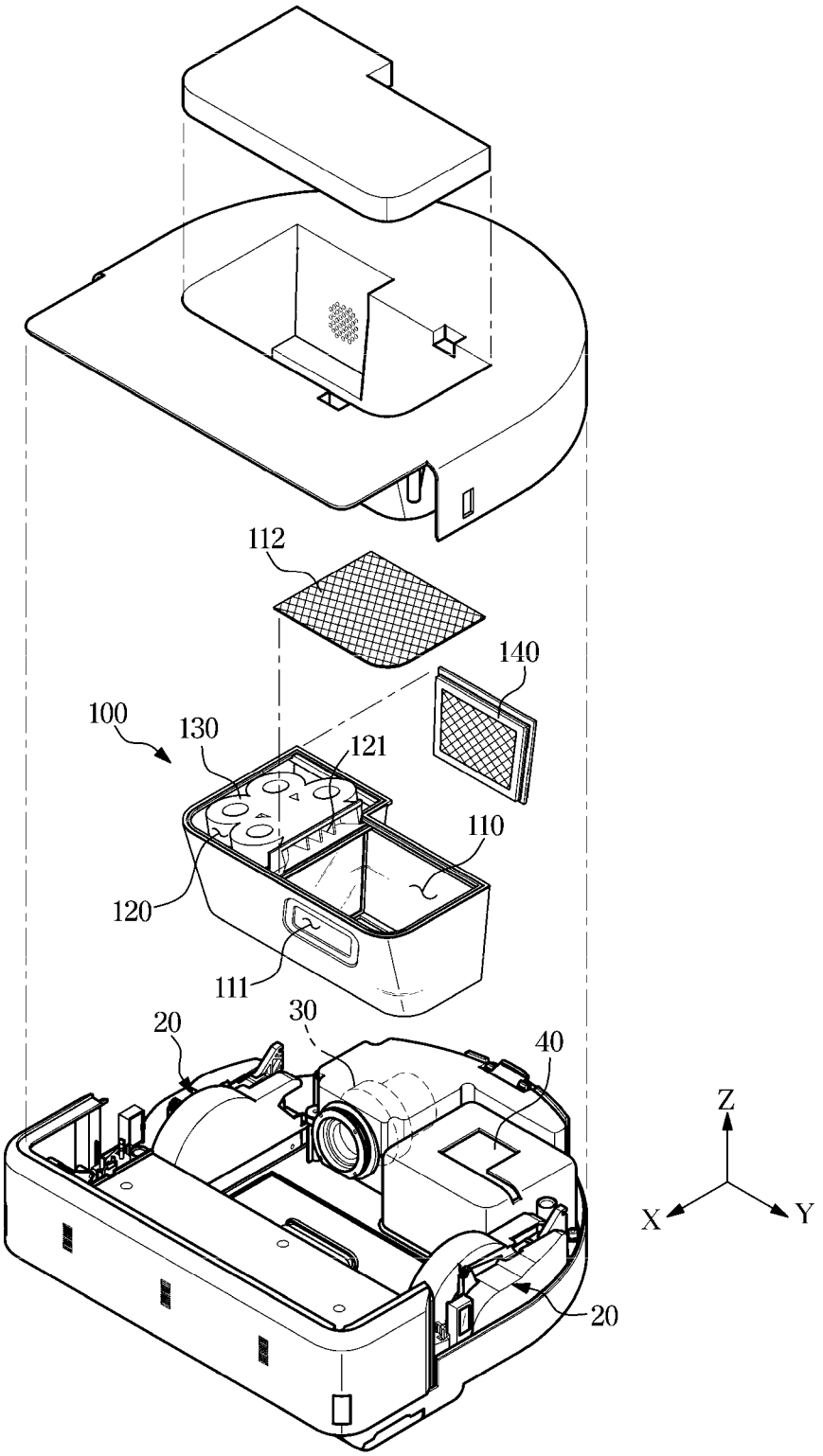
FIG. 2 is an exploded perspective view of the robot cleaner according to an embodiment of the disclosure.
Figure 3:
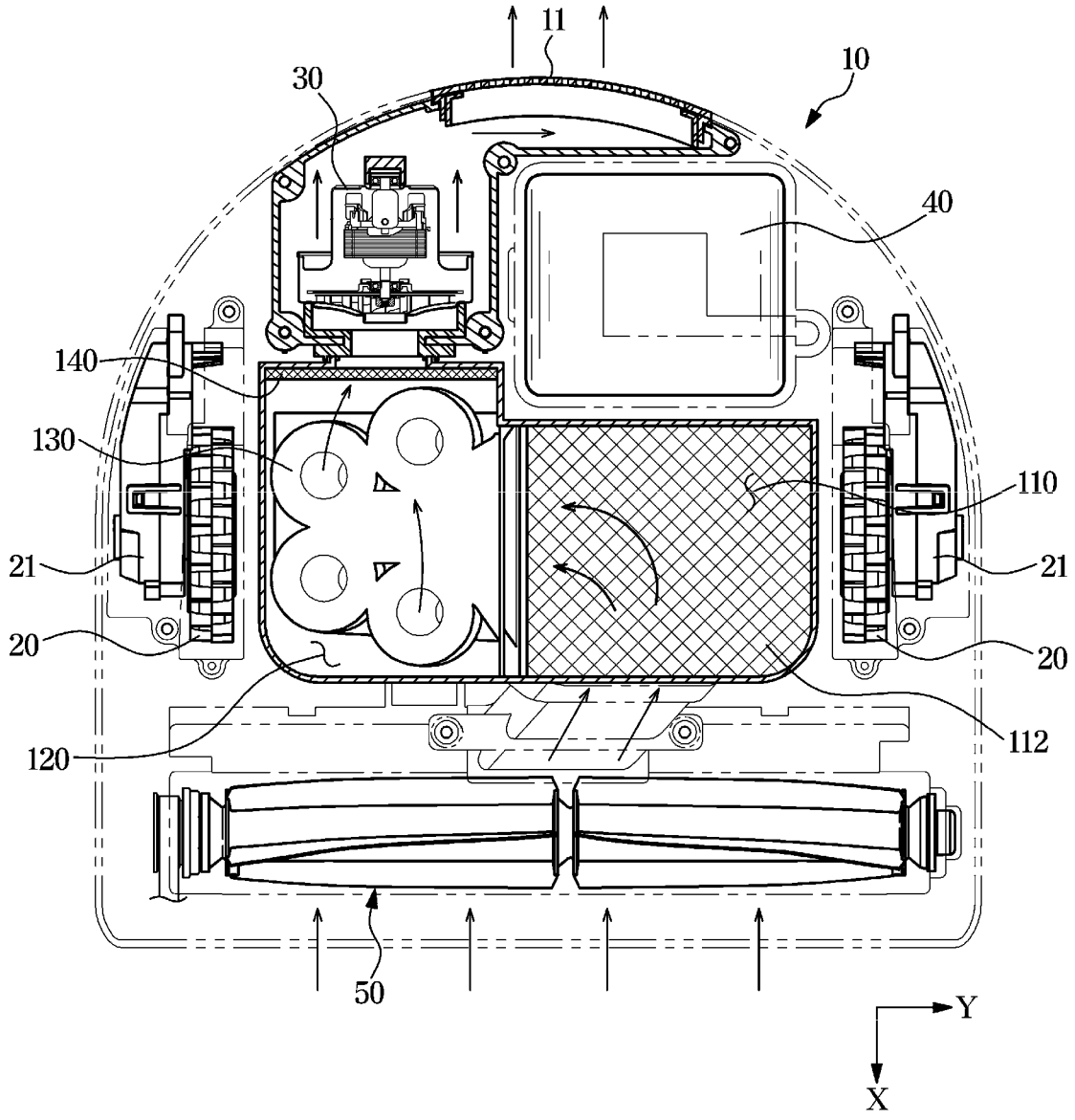
FIG. 3 is a plan view illustrating an internal configuration of the robot cleaner according to an embodiment of the disclosure.

FIG. 2 is an exploded perspective view of the robot cleaner according to an embodiment of the disclosure, and FIG. 3 is a plan view illustrating an internal configuration of the robot cleaner according to an embodiment of the disclosure.

Referring to FIGS. 2 and 3, the robot cleaner may include wheels 20 disposed on opposite sides of the main body 10, a suction motor 30 for generating a suction force, and a battery 40 for supplying power to the robot cleaner.

The wheel 20 may be connected to a driving motor 21. The wheel 20 may be provided to be rotated by receiving a driving force from the driving motor 21. The wheel 20 may be provided to be rotatable about a rotation axis. The rotation axis may be provided in parallel with the y-axis shown in the drawing. As the wheel 20 rotates, the robot cleaner may travel along the floor. In addition, because the wheels 20 are provided at the opposite sides of the main body 10, the moving direction of the robot cleaner may be regulated by adjusting the degree of rotation of each of the wheels 20.

The suction motor 30 may generate a suction force for drawing in air from the floor. Air may be introduced into the dust container 100 through the suction force. The dust container 100 may separate dust from the air introduced into the dust container 100, store the dust, and discharge the air from which the dust is removed to the outside of the dust container 100.

The robot cleaner may include a brush device 50. The brush device 50 may be installed in the front of the robot cleaner. The brush device 50 may sweep the dust on the floor. For example, the brush device 50 may transfer the dust directly in contact with a brush to the dust container 100 by rotating the brush. The brush device 50 may be provided to deliver the dust on the floor together with the suction motor 30 to the dust container 100.

The dust container 100 may be disposed between the pair of wheels 20. The dust container 100 may include a first chamber 110 and a second chamber 120. The first chamber 110 and the second chamber 120 may be arranged side by side in a direction parallel to the rotation axis of the wheels 20. In other words, the first chamber 110 and the second chamber 120 may be disposed to be adjacent to each other in a direction parallel to the y-axis in the drawing. The first chamber 110 and the second chamber 120 may be arranged side by side in a direction crossing the moving direction of the robot cleaner. For example, when the robot cleaner moves in the x-axis direction, the first chamber 110 and the second chamber 120 may be arranged side by side in the y-axis direction.

The first chamber 110 may include a first filter 112. The first filter 112 may be arranged side by side with a bottom surface. However, the disclosure is not limited thereto. The first filter 112 may be arranged substantially side by side with the bottom surface. Therefore, the first filter 112 may be arranged to be inclined within a predetermined angle range with respect to the bottom surface.

The first chamber 110 may be disposed to be biased to one side with respect to a central axis in an advancing direction of the main body 10. For example, the first chamber 110 may be disposed to be biased in the y-axis with respect to the advancing direction of the main body 10 parallel to the x-axis.

In addition, the first chamber 110 may be arranged side by side with the battery 40. In other words, the first chamber 110 may be disposed in front of the battery 40. The first chamber 110 may be arranged side by side with the battery 40 in the advancing direction of the main body 10. The first chamber 110 may be arranged side by side with the battery 40 in the x-axis direction.

The first filter 112 may include a mesh. The first filter 112 may also include a perforated plate including pores. The first filter 112 may be provided to separate relatively large dust from the dust introduced into the first chamber 110. The fineness of the mesh of the first filter 112 or the pore size of the perforated plate may vary according to design specifications.

The second chamber 120 may be provided to be connected to the first chamber 110. The second chamber 120 may include a communication hole 121 connecting the first chamber 110 and the second chamber 120. The second chamber 120 may be arranged side by side with the first chamber 110. The first chamber 110 and the second chamber 120 may be disposed between the pair of wheels 20.

The second chamber 120 may include a dust separator for separating dust in air. The dust separator may include a cyclone unit 130. A plurality of the cyclone units 130 may be provided. The cyclone unit 130 may semi-permanently separate dust. The cyclone unit 130 may separate dust without replacement or washing.

The second chamber 120 may be disposed to be biased to one side with respect to the central axis in the advancing direction of the main body 10. For example, the second chamber 120 may be disposed to be biased in the y-axis with respect to the advancing direction of the main body 10 parallel to the x-axis.

In addition, the second chamber 120 may be arranged side by side with the suction motor 30. In other words, the second chamber 120 may be disposed in the front of the suction motor 30. The second chamber 120 may be arranged side by side with the suction motor 30 in the advancing direction of the main body 10. The second chamber 120 may be arranged side by side with the suction motor 30 in the x-axis direction.

The second chamber 120 may include a second filter 140. The second filter 140 may be provided to cover a discharge port of the second chamber 120 through which air is discharged. The second filter 140 may filter out dust smaller than the first filter 112. For example, the second filter 140 may include a High Efficiency Particulate Air (HEPA) filter.

The second filter 140 may be detachably coupled to the second chamber 120. When dust is accumulated in the second filter 140, the user may separate the second filter 140 from the second chamber 120 to wash or replace the filter.

The second filter 140 may be disposed substantially perpendicular to the bottom surface of the robot cleaner. The second filter 140 and the first filter 112 may be disposed substantially perpendicular to each other.

In general, the robot cleaner may not include the cyclone unit in order to lower the height of the robot cleaner. Because the cyclone unit has a relatively high height, the height of the robot cleaner including the cyclone unit may be relatively high. As described above, when the height of the robot cleaner is high, the driving performance of the robot cleaner may be degraded, or the cleanable region of the robot cleaner may be reduced.

When the cyclone unit is provided, the service life of the filter may be extended. For example, when the cyclone unit 130 is provided in the second chamber 120, the service life of the second filter 140 may be extended. Because the cyclone unit 130 separates dust from the air introduced into the second chamber 120, the dust accumulated in the second filter 140 may be relatively reduced. As the amount of dust accumulated in the second filter 140 is relatively reduced, the service life of the second filter 140 may be extended.

According to an embodiment of the disclosure, a robot cleaner may include a cyclone unit. The service life of the filter may be extended by the provision of the cyclone unit. In addition, the robot cleaner may have a compact main body size despite the inclusion of the cyclone unit. According to an embodiment of the disclosure, the robot cleaner may improve the driving performance by having a compact main body size, FIG. 4 is a side cross-sectional view of the robot cleaner according to an embodiment of the disclosure, and FIG. 5 is a rear cross-sectional view of the robot cleaner according to an embodiment of the disclosure.

Figure 4:
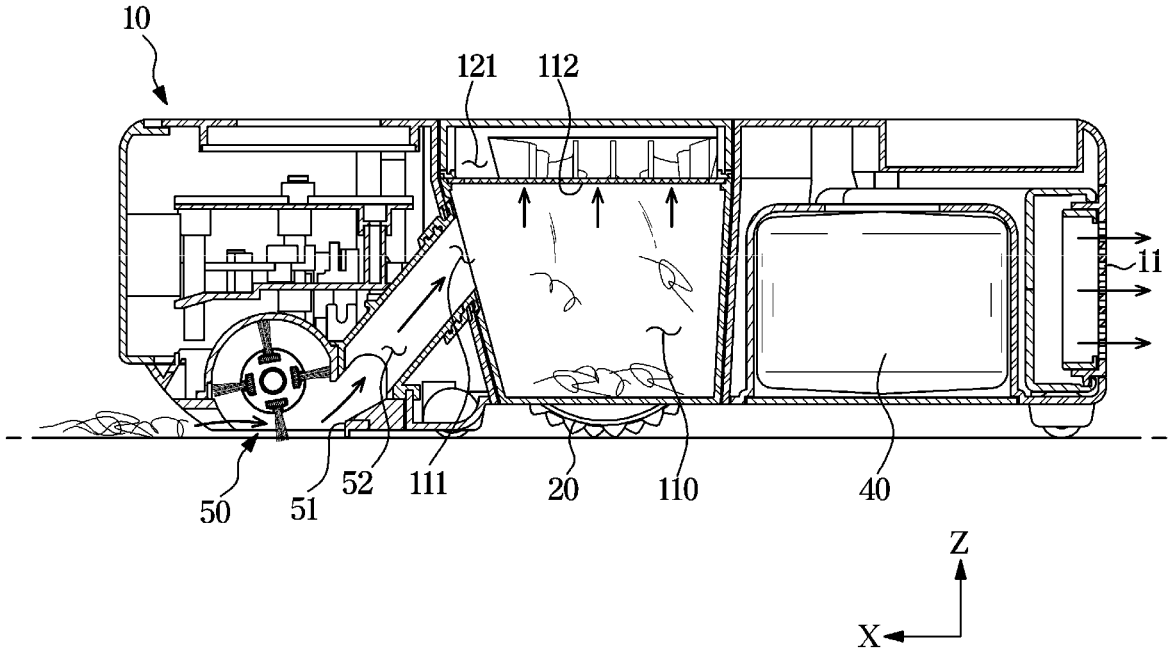
FIG. 4 is a side cross-sectional view of the robot cleaner according to an embodiment of the disclosure.
Figure 5:
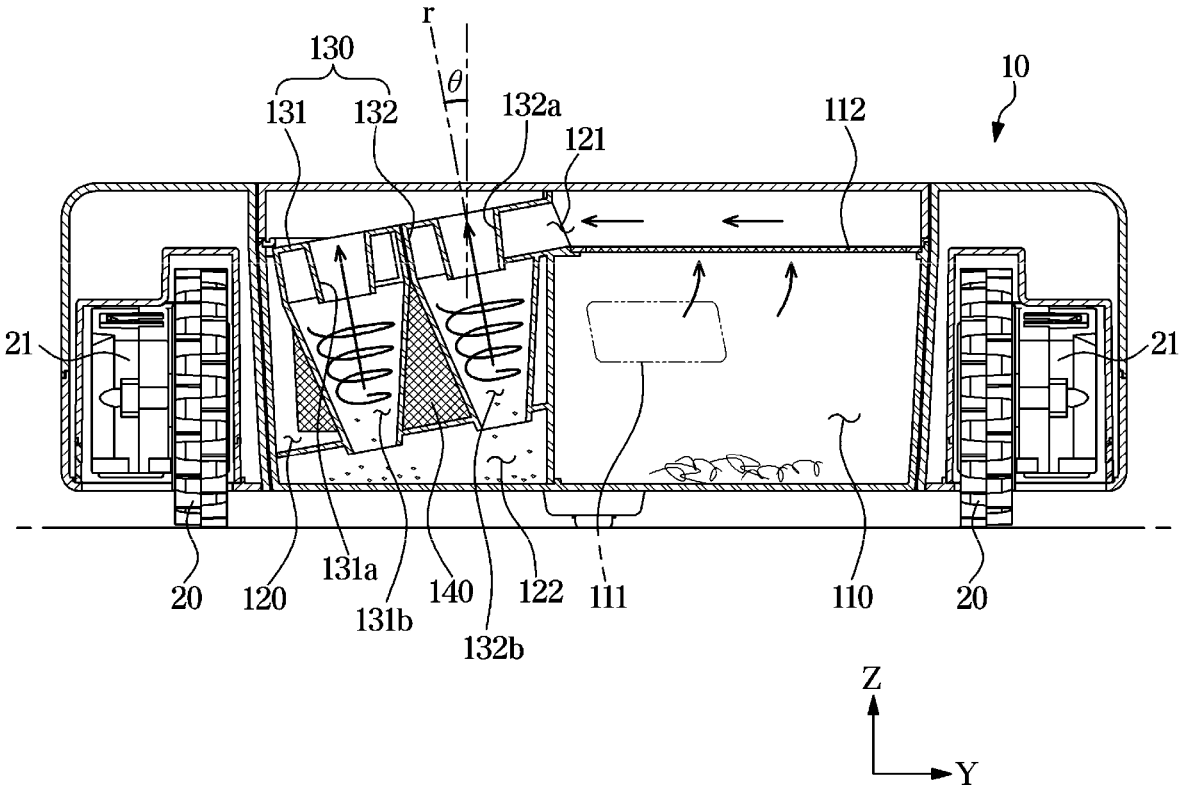
FIG. 5 is a rear cross-sectional view of the robot cleaner according to an embodiment of the disclosure.

Referring to FIG. 4, the robot cleaner may include a suction port 51 provided on the bottom surface of the main body 10 to introduce (e.g., draw in) air. The robot cleaner may also include a suction passage 52 for delivering the air drawn in through the suction port 51 to the first chamber 110. The suction passage 52 may be provided to be inclined upward. Dust and air from the floor may be introduced into the first chamber 110 through the suction port 51 and the suction passage 52 by the brush device 50 and the suction force of the suction motor 30.

The first chamber 110 may include an inlet port 111. The inlet port 111 may be provided to allow the suction passage 52 to communicate with the first chamber 110. The width of the inlet port 111 may be less than half the width of the dust container 100. In this case, the width may refer to the length in the x-axis direction in the drawing. The inlet port 111 may be disposed to be biased to one side with respect to a center line in the running direction of the main body 10. In other words, the inlet port 111 may be disposed to be biased in the y-axis direction with respect to the center line of the robot cleaner parallel to the x-axis direction in the drawing.

The air introduced into the first chamber 110 may spirally rotate in the first chamber 110 and may flow into the second chamber 120. When the running direction of the robot cleaner is referred to as a first direction, the air introduced into the inlet port 111 through the suction passage 52 may be introduced in the first direction. For example, air may be introduced into the upward direction as the first direction. The second chamber 120 may be arranged side by side in a second direction crossing the first direction with respect to the first chamber 110. Therefore, the direction of air introduced into the first chamber 110 through the inlet port 111 and the direction of air introduced into the second chamber 120 through the communication hole 121 may cross each other.

When the air introduced into the first chamber 110 flows into the second chamber 120, the dust contained in the air may collide with partition walls of the first chamber 110. A part of the dust may be accumulated on the bottom surface of the first chamber 110 by colliding with the partition walls of the first chamber 110.

The first chamber 110 may include the first filter 112 arranged approximately side by side with the bottom surface. Dust in the air may not pass through the first filter 112. Thus, a part of the dust may be accumulated on the bottom surface of the first chamber 110 by being filtered out by the first filter 112.

Through the above process, the dust contained in the air may be first filtered out in the first chamber 110, and the dust filtered out may be accumulated inside the first chamber 110.

The dust and air that have passed through the first filter 112 may be introduced into the second chamber 120 through the communication hole 121. The communication hole 121 may connect the first chamber 110 and the second chamber 120. The communication hole 121 may be disposed at a higher position than the inlet port 111. When the communication hole 121 is disposed at a higher position than the inlet port 111, the dust may remain in the first chamber 110 without being introduced into the communication hole 121 by gravity. The dust having a small size does not have an influence of gravity and may not be filtered out by the first filter 112. Thus, dust having a small size may be introduced into the second chamber 120 through the communication hole 121.

Referring to FIG. 5, the air introduced into the second chamber 120 through the communication hole 121 may pass through the cyclone unit 130.

A plurality of the cyclone units 130 may be provided. The cyclone 130 unit may include a first cyclone unit 131 and a second cyclone unit 132. The first cyclone unit 131 and the second cyclone unit 132 may be arranged side by side in the second direction. In other words, the first cyclone unit 131 and the second cyclone unit 132 may be arranged side by side in the direction parallel to the y-axis in the drawing.

The first cyclone unit 131 may include a first dust separation space 131*b* and a first air discharge portion 131*a*. Air and dust may spirally rotate in the first dust separation space 131*b*. The air that has moved downward while passing through the first dust separation space 131*b* may move upward again and be discharged from the first cyclone unit 131 through the first air discharge portion 131*a*. While passing through the first dust separation space 131*b*, a part of the dust may be stored in a dust storage 122 provided below the second chamber 120.

Likewise, the second cyclone unit 132 may include a second dust separation space 132*h* and a second air discharge portion 132*a*. Air and dust may spirally rotate in the second dust separation space 132*b*. The air that has moved downward while passing through the second dust separation space 132*b* may move upward again and be discharged from the second cyclone unit 132 through the second air discharge portion 132*a*. While passing through the second dust separation space 132*b*, a part of the dust may be stored in the dust storage 122 provided below the second chamber 120.

The air and dust that have passed through the cyclone unit 130 may be discharged from the second chamber 120 through the second filter 140. As described above, the second filter 140 may include a HEPA filter. Therefore, the second filter 140 may filter out the dust that is not separated in the first chamber 110 and the second chamber 120. When the cyclone unit 130 is not provided, a large amount of dust may be accumulated in the second filter 140 because the dust is not removed before the second filter 140. Because of this, the replacement and cleaning cycle of the second filter 140 may be shortened, which may be inconvenient for the user. According to an embodiment of the disclosure, the amount of dust accumulated in the filter, including the first chamber 110, the first filter 112 and the cyclone unit 130, is relatively small, which may extend the service life of the filter.

Referring to FIG. 5, the cyclone unit 130 may be disposed to be inclined at a predetermined angle with respect to a vertical axis perpendicular to the bottom surface. The vertical axis may be parallel to the z-axis in the drawing.

A central axis r of the cyclone unit 130 may be disposed to be inclined at a predetermined angle with respect to the z-axis. For example, the central axis r of the cyclone unit 130 may be inclined at a predetermined angle in a direction parallel to the y-axis with respect to the z-axis. The cyclone unit 130 may be disposed to be inclined by θ in a direction parallel to the y axis with respect to the vertical axis. For example, θ may be 13° to 17°.

When the cyclone unit 130 is disposed to be inclined at a predetermined angle, a traveling direction of air introduced into the second chamber 120 through the communication hole 121 may be inclined at the predetermined angle. The air that is introduced into the second chamber 120 through the communication hole 121 may move downward with a slanted orientation. The air that is introduced into the second chamber 120 may be introduced into the respective cyclone units 130 while moving downward with the slanted orientation.

As the cyclone unit 130 is disposed to be inclined by a predetermined angle as described above, the height of the robot cleaner of the disclosure may be lowered. When the cyclone unit 130 is arranged parallel to the vertical axis, the height of the robot cleaner is higher than when the cyclone unit 130 is disposed to be inclined. Therefore, by disposing the cyclone unit 130 to be inclined, the height of the cyclone unit 130 and the robot cleaner may be lowered. As a result, according to an embodiment of the disclosure, the robot cleaner may have a compact main body size despite including the cyclone unit 130. In addition, the robot cleaner may prevent degradation of the driving performance and the cleanable region despite including the cyclone unit 130.

Figure 6:
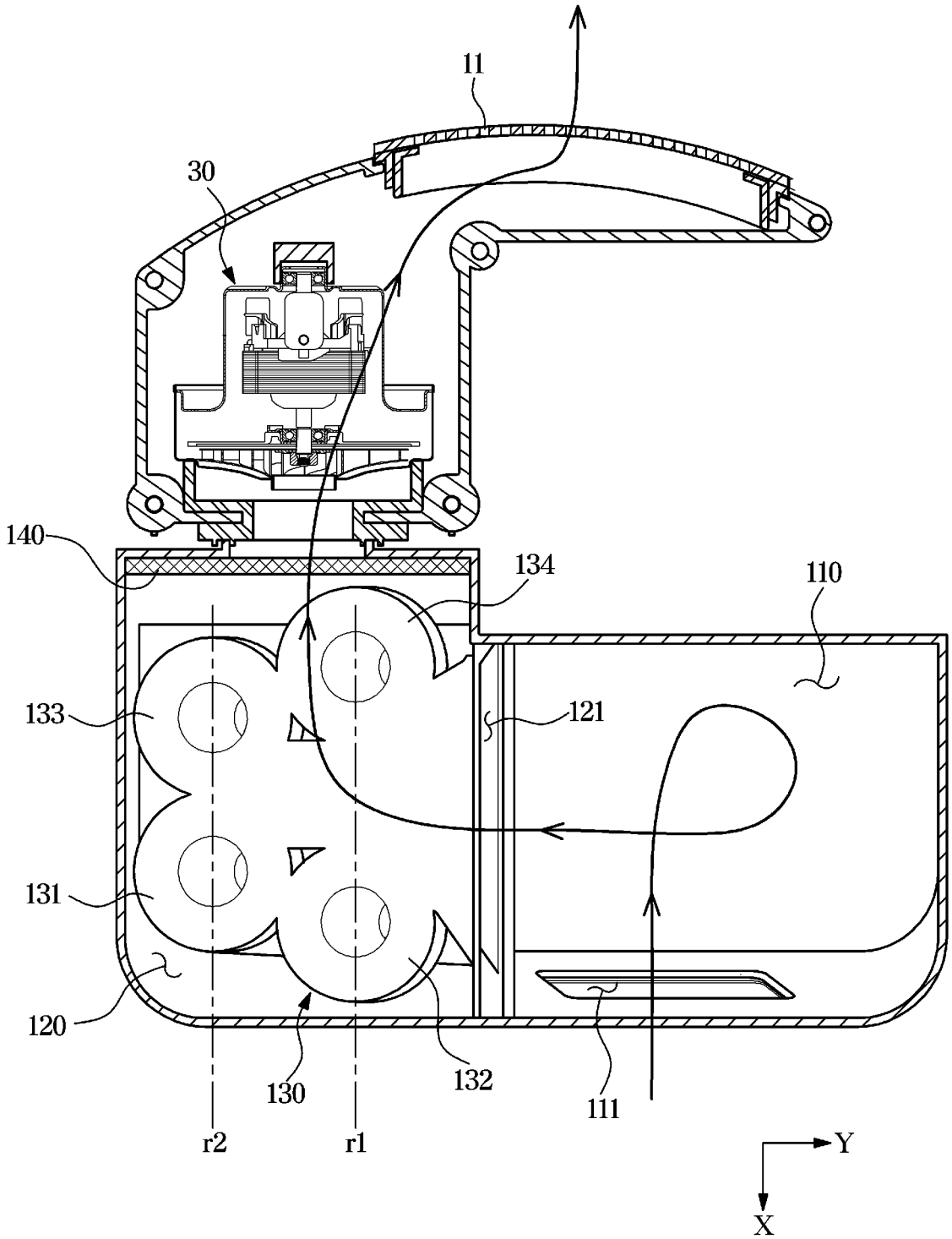
FIG. 6 is a plan view of a partial configuration of the robot cleaner according to an embodiment of the disclosure.

FIG. 6 is a plan view of a partial configuration of the robot cleaner according to an embodiment of the disclosure.

Referring to FIG. 6, a movement route of air in the robot cleaner according to an embodiment of the disclosure will be described.

The air that has been introduced into the first chamber 110 through the inlet port 111 may flow into the second chamber 120 through the communication hole 121 after rotating in the first chamber 110. Although not specifically illustrated in the drawing, dust in the air may be partially separated while passing through the first filter 112 before being introduced into the communication hole 121. In addition, although not specifically illustrated in the drawing, the air that has been introduced into the second chamber 120 may be introduced into each of the plurality of cyclone unit 130 to be separated from dust, and may be discharged to the outside of the robot cleaner through an air discharge portion 11 of the main body 10 after passing through the second filter 140.

A direction in which air is introduced into the first chamber 110 may be parallel to the x-axis. A direction in which air is introduced into the second chamber 120 may be parallel to the y-axis. Therefore, the direction in which air is introduced into the first chamber 110 and the direction in which air is introduced into the second chamber 120 may cross each other. Due to the traveling direction of the air as above, the air that has been introduced into the first chamber 110 may flow into the second chamber 120 after rotating clockwise along the partition walls of the first chamber 110. Because the communication hole 121 is disposed at a higher position than the inlet port 111 in the z-axis direction, the air may move upwards, and dust may fall below the first chamber 110 by gravity.

According to an embodiment of the disclosure, the cyclone units 130 may be arranged in a plurality of rows. For example, the cyclone units 130 may be arranged in two rows. In addition, two or more of the cyclone units 130 may be arranged in each row. For example, the cyclone unit 130 may be disposed in each of a first row r1 and a second row r2. The second cyclone unit 132 and a fourth cyclone unit 134 may be arranged side by side in the first row r1. The first cyclone unit 131 and a third cyclone unit 133 may be arranged side by side in the second row r2.

The cyclone units 132 and 134 disposed in the first row r1 and the cyclone units 131 and 133 disposed in the second row r2 may be arranged to cross each other. In other words, the first cyclone unit 131 and the second cyclone unit 132 may not be arranged side by side in the y-axis direction, but may be arranged to be biased. Likewise, the third cyclone unit 133 and the fourth cyclone unit 134 may not be arranged side by side in the y-axis direction, but may be arranged to be biased.

As described above, the dust separation efficiency of the cyclone unit may be improved by providing a plurality of the cyclone units. In addition, despite the increase in the number of the cyclone units, space utilization may be improved.

As is apparent from the above, a robot cleaner according to an embodiment of the disclosure may improve the dust separation efficiency by including a cyclone dust separator.

The robot cleaner according to an embodiment of the disclosure may extend the service life of a filter by improving the dust separation efficiency.

The robot cleaner according to an embodiment of the disclosure may have a compact main body size despite including the cyclone dust separator.

The robot cleaner according to an embodiment of the disclosure may extend the service life of the filter by including the cyclone dust separator and may improve the driving performance by having the compact main body size.

While the disclosure has been described with reference to various embodiments thereof, it will be understood by those skilled in the art that various changes in form and details may be made therein without departing from the spirit and scope of the disclosure as defined by the appended claims and their equivalents.

What is claimed is:

1. A robot cleaner comprising:

a main body including wheels configured to rotate about a rotation axis;

a brush device provided in the main body to draw in air, the air comprising dust;

a first chamber, through which the air drawn in through the brush device is introduced, configured to change a traveling direction of the introduced air; and a second chamber connected to the first chamber and including a dust separator configured to separate dust contained in air that is introduced into the second chamber from the first chamber, wherein the second chamber is arranged side by side with the first chamber in a direction in which the rotation axis extends such that the rotational axis intersects the first chamber and the second chamber, and wherein the dust separator includes a plurality of cyclone units arranged in two or more rows along a first direction in which the rotation axis extends.

2. The robot cleaner according to claim 1, wherein the direction of air introduced into the first chamber and the direction of air discharged from the first chamber cross each other.

3. The robot cleaner according to claim 2, wherein the direction of air introduced into the second chamber and the direction of air discharged from the second chamber cross each other.

4. The robot cleaner according to claim 1, wherein, when the rows extend in a second direction crossing the first direction, each of a plurality of first cyclone units arranged along a first row and each of a plurality of second cyclone units arranged along a second row are disposed to cross each other with respect to the first direction.

5. The robot cleaner according to claim 1, wherein the cyclone units are arranged to be inclined at a predetermined angle with respect to the direction in which the rotation axis extends.

6. The robot cleaner according to claim 1, wherein the first chamber further includes a first filter arranged side by side with a bottom surface.

7. The robot cleaner according to claim 6, wherein the first filter includes a mesh or a plate including pores.

8. The robot cleaner according to claim 6, wherein the second chamber includes a second filter disposed to cover a discharge port through which air is discharged from the second chamber.

9. The robot cleaner according to claim 1, wherein the wheels include a first wheel and a second wheel disposed at opposite sides of the main body, and wherein the first chamber and the second chamber are disposed between the first wheel and the second wheel.

10. The robot cleaner according to claim 1, further comprising a battery disposed inside the main body, wherein the battery and the first chamber are arranged side by side in a second direction crossing a first direction in which the rotation axis extends.

11. The robot cleaner according to claim 10, further comprising a suction motor arranged side by side with the battery in the first direction and configured to generate a suction force, wherein the second chamber and the suction motor are arranged side by side in the second direction.

12. The robot cleaner according to claim 1, wherein the second chamber is disposed to be biased to one side with respect to a central axis in an advancing direction of the main body.

13. The robot cleaner according to claim 1, wherein the first chamber includes an inlet port through which air is introduced into the first chamber and a communication hole allowing the first chamber to communicate with the second chamber, and wherein the second chamber includes the communication hole through which air is introduced into the second chamber from the first chamber and a discharge port through which air is discharged from the second chamber.

14. The robot cleaner according to claim 13, wherein the communication hole is disposed at a higher position than the inlet port and the discharge port.

15. A robot cleaner comprising:

a main body including wheels configured to rotate about a rotation axis and a suction port configured to draw in dust; and a dust container, detachably mounted to the main body, configured to separate and store dust from air drawn in through the suction port, wherein the dust container includes a first chamber in which air is introduced in a first direction and air is discharged in a second direction crossing the first direction, and a second chamber in which air is introduced in the second direction and air is discharged in the first direction, wherein the second chamber includes a dust separator configured to separate dust included in air received via the first chamber, and wherein the second chamber is arranged side by side with the first chamber in the second direction such that the rotation axis intersects the first chamber and the second chamber.

16. The robot cleaner according to claim 15, wherein the dust separator includes a plurality of cyclone units arranged in two or more rows along the second direction.

17. The robot cleaner according to claim 16, wherein the plurality of cyclone units is arranged to be inclined at a predetermined angle with respect to the second direction.

18. The robot cleaner according to claim 15, wherein the dust container further includes:

a first filter provided inside the first chamber and arranged side by side with a bottom surface; and a second filter configured to cover a discharge port through which air is discharged from the second chamber and disposed perpendicular to the bottom surface.

19. A robot cleaner comprising:

a main body including wheels configured to rotate about a rotation axis; and a dust container detachably mounted to the main body, wherein the dust container includes a first chamber and a second chamber arranged side by side in a direction crossing an advancing direction of the main body such that the rotational axis intersects the first chamber and the second chamber, wherein the first chamber includes an inlet port through which air is introduced, and a communication hole disposed at a higher position than the inlet port and allowing the first chamber to communicate with the second chamber, and wherein the second chamber includes a discharge port through which air introduced into the communication hole is discharged and disposed at a lower position than the communication hole, and a cyclone unit configured to separate dust contained in air.

* * * * *